United States Patent [19]

Unger et al.

[11] Patent Number: 4,919,019

[45] Date of Patent: Apr. 24, 1990

[54] DEVICE FOR THE REMOVAL OR INSTALLATION OF FLUORESCENT TUBES OF THE SINGLE-PIN TYPE

[75] Inventors: Henry M. Unger, Weston; Michael Vorobyov, Bethel, both of Conn.

[73] Assignee: Unger Licencing Ltd., N.Y.

[21] Appl. No.: 362,710

[22] Filed: Jun. 7, 1989

[51] Int. Cl.[5] ..... B25B 3/00

[52] U.S. Cl. ..... 81/53.12

[58] Field of Search ..... 81/53.12, 53.11, 53.1

[56] References Cited

U.S. PATENT DOCUMENTS 3,776,584 12/1973 Van Gerven ..... 81/53.12

3,799,599 3/1974 Jordan ..... 81/53.11

*Primary Examiner*—Frederick R. Schmidt

*Assistant Examiner*—Lawrence Cruz

*Attorney, Agent, or Firm*—Abelman Frayne Rezac & Schwab

[57] ABSTRACT

A device for removing and installing single-pin type fluorescent tubes has a cradle in which a fluorescent tube is frictionally held, and a pusher mechanism that can be extended by rotation of a pole on which the cradle is supported.

3 Claims, 3 Drawing Sheets

DEVICE FOR THE REMOVAL OR INSTALLATION OF FLUORESCENT TUBES OF THE SINGLE-PIN TYPE

FIELD OF THE INVENTION

This invention relates to a device, which can be pole-mounted and used in the removal or installation of fluorescent tubes in remotely located lighting fixtures. Typically, such poles are up to 30 feet in length, the removal or installation of a fluorescent tube being performed by a person standing on the floor of a gymnasium, workshop, warehouse or factory, the lighting fixture being located at a position spaced remotely above the floor. The use of such a device enables the removal and replacement of fluorescent tubes in such lighting fixtures without employing a step ladder, or some form of portable elevator, such as is commonly known as a "cherry picker".

BACKGROUND OF THE INVENTION

Devices for removing fluorescent tubes located in remotely positioned lighting fixtures are known generally in the art, for example, from Unger et al. U.S. Pat. No. 4,791,835 issued Dec. 20, 1988. Such devices, however, are limited in their use to the removal and installation of fluorescent tubes having dual pins at their respective ends, and, which are required to be rotated through 90° in order to accomplish their removal or installation.

There commonly exists another type of fluorescent tube having only a single pin at its respective ends. The removal or installation of this type of fluorescent tube, instead of requiring rotation of the tube about its longitudinal axis requires displacement of the tube in the direction of its longitudinal axis, in order that the pin at one end of the tube can further compress the spring of its electrical contact, thus permitting axial movement of the tube and the withdrawal of the pin at the opposite end of the tube away from its electrical contact, and, out of its associated electrical socket.

As will be apparent, while the device of U.S. Pat. No. 4,791,835 has for its object the removal or installation of fluorescent tubes in remotely located fixtures, that device finds no application in the removal or installation of fluorescent tubes of the single-pin type. Any attempt to remove a single-pin fluorescent tube by use of the known device will of necessity require that the user apply lateral pressure to the pole supporting the device. This can cause slippage of the device axially of the fluorescent tube, with the probability that the device will slip off the fluorescent tube, which at that time may have been detached from one of its supporting holders. If this has happened, then, there is a danger of the fluorescent tube crashing onto the user's head, or, onto the floor area in the immediate vicinity of the user of the device. Clearly, such a problem cannot be countenanced as it constitutes a serious hazard to the safety of the user.

SUMMARY OF THE INVENTION

This invention has for its object to provide a device that can be employed in maximum safety in the removal and installation of single-pin type fluorescent tubes, the device, as in the prior art device, being adapted to be mounted on an extension pole of 30 feet or more in length.

According to the present invention, a device is provided which includes a cradle having end walls, between which extend parallely arranged rollers. The rollers are journalled in the end walls for rotation about the longitudinal axis of the respective rollers, and additionally, are mounted for lateral movement in the respective end walls. Resilient biasing means, preferably in the form of pre-tensioned elastic belts are employed to bias the rollers toWards each other. The end walls of the cradle are suitably configured such that the rollers can be passed over the external circumference of a fluorescent tube, which then becomes firmly secured within the cradle and held against axial displacement relative to the cradle.

In this manner, the cradle and the fluorescent tube can be secured one to the other from a remote location, and, in such a manner that the tube and the cradle can only move in unison one with the other.

In order to provide for movement of the cradle in the direction of the axis of the fluorescent tube, the cradle is provided With a pusher mechanism to be engaged with an end wall of the lighting fixture, and which can be operated by rotation of the pole supporting the cradle.

Thus, the device will be presented to the fluorescent tube With the pusher mechanism in a retracted condition and engaged with an end wall of the lighting fixture, and, the rollers of the device then engaged over the periphery of the fluorescent tube for it to securely grip the fluorescent tube.

After the device has been snapped onto the fluorescent tube, the pole supporting the device is given a one-half turn in either direction. So doing causes an eccentric ca which is fast with the pole to move the pusher mechanism axially in a direction parallel to the tube axis and against the adjacent end wall of the fixture. This movement produces a movement of the device and of the fluorescent tube in a direction opposite to the direction of movement of the pusher mechanism, and in turn results in bodily movement of the device and of the fluorescent tube away from the associated end wall of the lighting fixture. This frees the single pin at that end of the fluorescent tube from its supporting electrical sockets, thus permitting the device and the supported tube to be pulled downwardly, thus moving the pin of the fluorescent tube out of alignment with its associated socket. Movement of the tube, and thus of the device in the direction of the axis of the tube is permitted by further compression of the electrical contact spring at the other end of the tube.

Once the pin at one end of the tube has been released from and moved out of alignment with its electrical socket, the supporting pole can be given a further one half turn to permit the pusher mechanism to retract out of engagement with the associated end wall of the lighting fixture. As this happens, the pin at the other end of the fluorescent tube Will be ejected from its holding socket by the spring of its electrical contact, the fluorescent tube then being freely removable from the lighting fixture in an entirely safe manner in which the fluorescent tube is securely held within the cradle of the device.

The installation of a replacement fluorescent tube involves the same sequence, but, in a reversal thereof. To install a replacement fluorescent tube, one end of the fluorescent tube is snapped into the device of the present invention. The device is then moved upwardly to the lighting fixture and the pin at the other end of the fluorescent tube inserted into its socket. The device and the associated end of the fluorescent tube are then moved upwardly into the fixture, and, the supporting pole is given one half turn to extend the pusher mechanism. This forces the pin at the other end of the tube into its socket against the bias of the contact spring, and, permits the device to be moved upwardly in the lighting fixture to bring the pin at the associated end of the fluorescent tube into alignment with its supporting socket. The pusher mechanism is then retracted, thus permitting the fluorescent tube to move axially into seating engagement with its electrical socket at the adjacent end of the fluorescent tube, subsequent to which the device of the present invention is removed from the fluorescent tube by easing it downwardly by gently pulling on the supporting pole.

DESCRIPTION OF THE DRAWINGS

The device of the invention will now be described with reference to the accompanying drawings, which illustrate a preferred embodiment of the invention, and, in which.

DESCRIPTION OF THE PREFERRED EMBODIMENT

Figure 1:
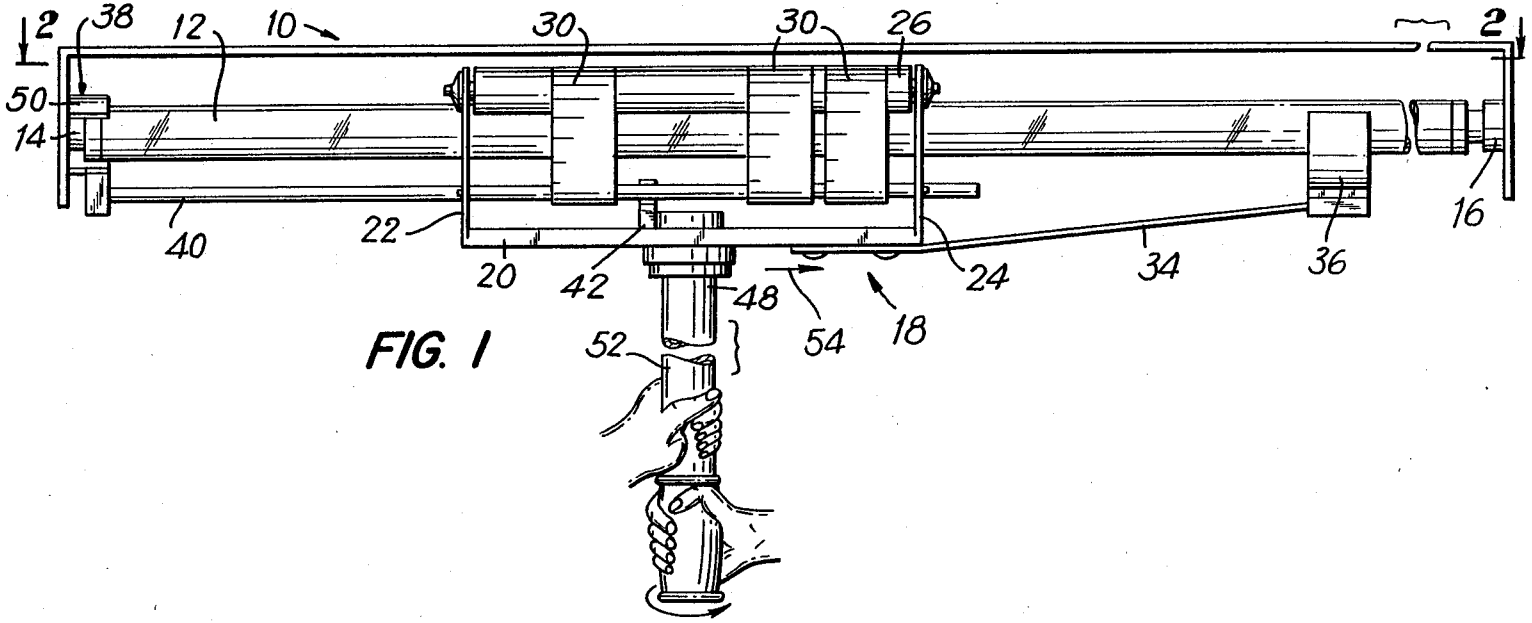
FIG. 1 is an illustration of the device of the present invention when in use in either removing or installing a fluorescent tube.
Figure 2:
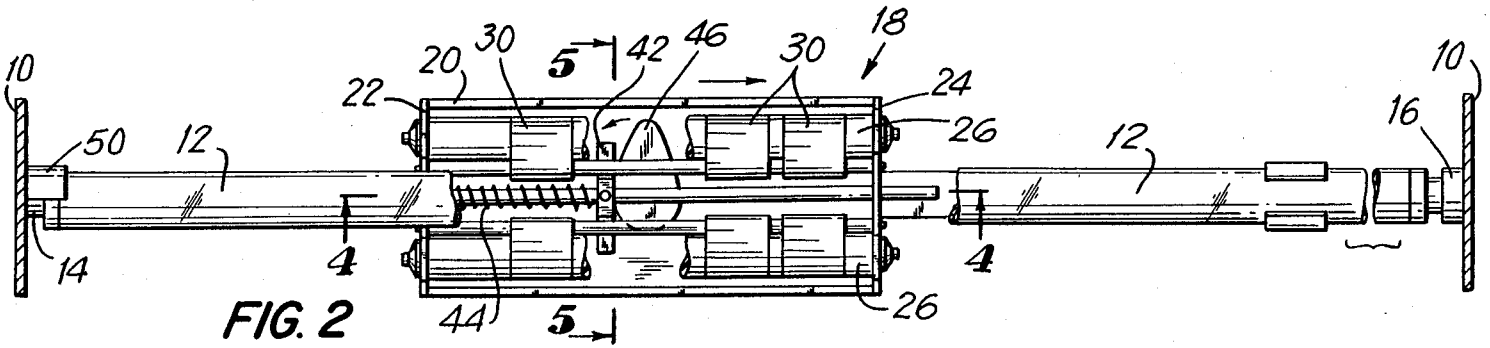
FIG. 2 is a cross-section taken on the line 2—2 in FIG. 1, and is a plan view of the device, a central portion of the fluorescent tube having been omitted for clarity of illustration.

In FIG. 1, a lighting fixture is indicated generally at 10, the lighting fixture being of the type adapted to receive a fluorescent tube 12 of the type having a single contact pin at its respective ends. The respective ends of the fluorescent tube are received in sockets 14, 16 which provide the required support and electrical connections to the fluorescent tube. As is conventional, one of the sockets, the socket 16, is spring-loaded to permit insertion of the fluorescent tube into the respective sockets.

In order to remove the tube 12 from the fixture 10, one normally would grasp the tube 12, push it axially against the bias of the spring-loaded socket 16, to move the pin at the end of the tube adjacent the socket 14 out of alignment with that socket, and then, remove the pin at the other end of the tube from its associated socket 16.

This, however, can only be done by hand in the event that direct access can be had to the lighting fixture. This, in turn, requires the use of either a step ladder or some form of elevator device in the event that the lighting fixture is positioned at a remote location, possibly 20 feet or more above the floor of a gymnasium, workshop, warehouse and the like. The present invention provides a device whereby such removal and installation of the fluorescent tube can be effected by a person standing on the floor of the building without the use of a step ladder or elevator device.

The device of the invention is indicated generally at 18 in the drawings, and includes a cradle 20, which conveniently is formed as a pressing from sheet steel. The cradle has upstanding end walls 22, 24, formed integrally therewith, the end walls, as more clearly illustrated in FIG. 3, being contoured for them to accept a fluorescent tube.

Figure 5:
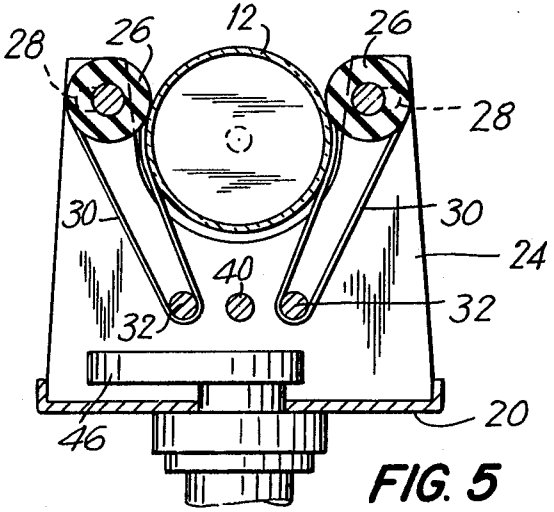

Extending between the end walls 22, 24 are rollers 26, which are journalled for rotation in the respective end walls, and which, additionally are moveable towards and away from each other in slots 28 in the respective end walls, as shown in chain-dotted lines in FIG. 5. The respective rollers 26 are so positioned and supported that they can be moved outwardly and over the periphery of the fluorescent tube, and then spring back to embrace and grip the fluorescent 12 under the influence of continuous elastic belts 30. The elastic belts 30 are entrained over the rollers 26, which themselves are formed from a stiff but compliant rubber-like material, and are stretched over support rods 32 journalled for rotation in the end walls 22, 24.

The structures so far described provide for the support of a fluorescent tube in the nip of the rollers 26 in a manner frictionally holding the fluorescent tube against axial displacement relative to the device. Conveniently, when longer tubes are to be handled, the device also is provided with a support bracket 34 carrying a resilient clip 36 formed of spring metal or plastics material which can snap over the fluorescent tube during installation of the device on the tube, thus providing greater stability in the handling of the tube once it has been removed from the lighting fixture.

Figure 3:
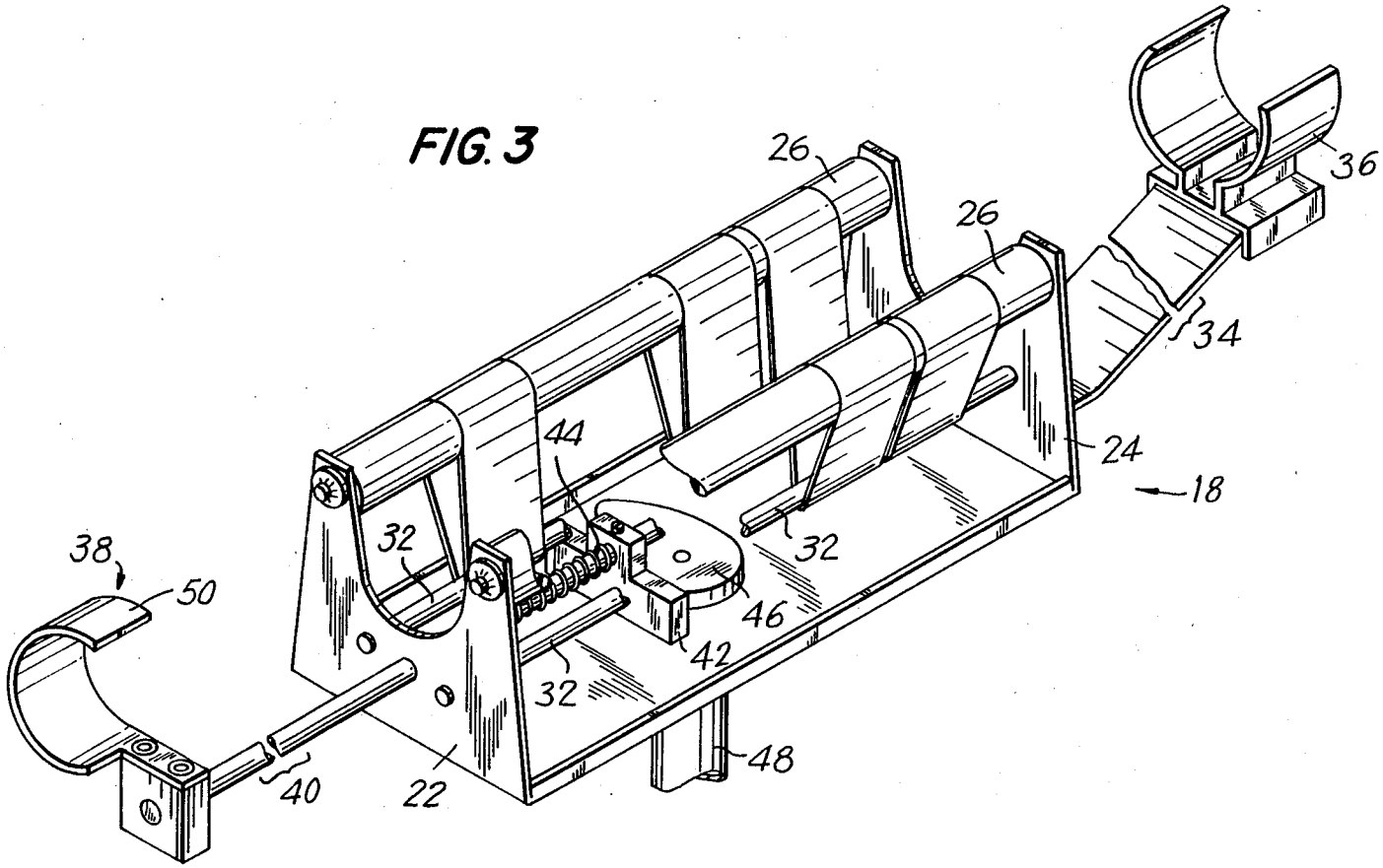
FIG. 3 is a perspective view of the device of the present invention, again, with portions broken away for clarity of illustration.
Figure 4:
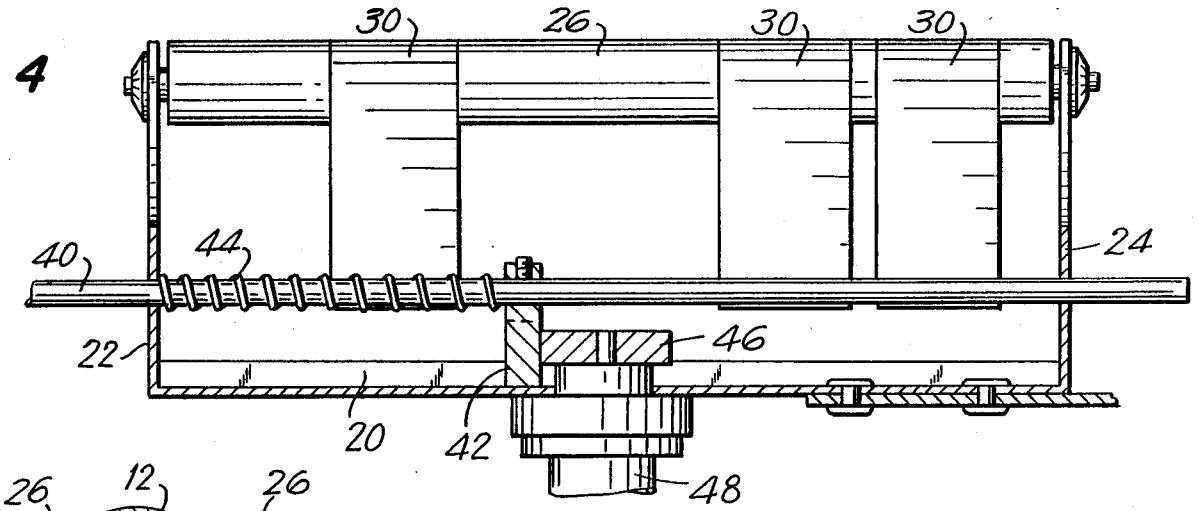
FIG. 4 is a longitudinal cross-section through the device, taken on the line 4—4 of FIG. 2; and, FIG. 5 is a transverse cross-section through the device taken on the line 5—5 of FIG. 2.

In order to permit removal or installation of a fluorescent tube in the lighting fixture 1, the device of the present invention is provided with a pusher mechansim indicated generally at 38 in FIGS. 1 and 3. The pusher mechanism includes a rod 40 which extends through the end walls 22, 24 and is axially slidable therein. Intermediate the end walls 22 and 24, a pusher block 42 is rigidly secured to the rod 40, and provides a reaction member for one end of a spring 44, the other end of which reacts against the end wa)1 22. In this manner, the spring 44 at all times biases the pusher mechanism into a retracted position.

In order to advance the pusher mechanism against the bias of the spring 44, an eccentric cam 46 is provided, the cam 46 being rigidly attached to a shaft 48 journalled for rotation in the cradle 20. Conveniently, the shaft 48 is a short stub-shaft to which an extension pole can be attached in any manner as well knoWn in the art. Upon rotation of the stub-shaft 48, the eccentric cam is rotated, and in turn reacts against the pusher block to move the rod 40 against the bias of the spring 44 and into an extended position.

Conveniently, the rod 40 can be provided at its free end with a clip 50 adapted to engage over the fluorescent tube and in this way provide even greater stability to the fluorescent tube When held in the device.

In order to remove a fluorescent tube 12 from a fixture 10, an extension pole 52 of suitable length is attached to the stub-shaft 48, and, the device is then passed upwardly under the control of the extension pole. Eventually, the rollers 26 will come into surface contact with the fluorescent tube 12, and will act to align the device with the fluorescent tube.

The device is then shifted in the direction of the pusher mechanism 38 to bring the pusher mechanism into contact with the adjacent end wall of the lighting fixture, subsequent to which the extension pole 52 and the device 18 are gently pushed upwardly to cause the rollers 26 to engage over the tube, and, to cause the clip 36 to snap onto the tube.

The extension pole 52 is then rotated through one quarter turn in an appropriate direction, which causes the eccentric cam to force the pusher block 42 against the bias of the spring 44, and, in so doing cause the rod 40 to extend outwardly of the device and into pushing engagement with the associated end wall of the lighting fixture 10.

This will cause movement of the device, and with it the fluorescent tube gripped in the device in the direction of the arrow 54 in FIG. 1, thus causing the single pin at the end of the tube positioned in the socket 14 to be pulled out of its socket and freed at that end from connection with the lighting fixture. The device can then be moved downward slightly to move that end of the tube out of engaging alignment with the socket 14, at which time the extension pole is rotated reversely to permit retraction of the pusher mechanism 38.

The fluorescent tube, which is at that time securely held in the device, can then be angled downwardly with respect to the lighting fixture 10, and the pin at its opposite end removed from the socket 16.

A closely similar procedure is adopted in the installation of a replacement fluorescent tube. Firstly, the fluorescent tube is snapped into the cradle and the clip 36 with one of its ends in substantial alignment with the clip 50.

The device with the fluorescent tube trapped therein is then passed upwardly, and, the pin at the end of the fluorescent tube remote from the device is inserted into the socket 16. The device is then moved upwardly to bring the pin at the end of the tube adjacent the pusher device into proximity with the socket 14, subsequent to which the pusher mechanism is extended to force the fluorescent tube axially against the bias imposed by the spring-loaded socket 16. The pin at the end of the tube adjacent the pusher mechanism is then moved into alignment with the socket 14.

The pusher mechanism is then retracted by rotating the extension pole reversely, or, permitting it to rotate reversely under the force of the spring 44, this, in turn, permitting the fluorescent tube to move axially under the influence of the bias imposed by the spring force of the socket 16.

The device 18 is then pulled gently downwardly to release it from the fluorescent tube, which is at that time securely held in the respective sockets 14 and 16. If, for any reason, the fluorescent tube did not become firmly held by the socket 14, then, any attempt at downward movement of the device will proceed with the fluorescent tube held captive in the device, and, without any danger to the user.

While a preferred embodiment of the invention has been shown and described, it is to be understood that various modifications in the structures illustrated can be made without departing from the scope of the invention as defined in the appended claims. For example, a scroll cam and follower pin could be employed in substitution for the eccentric cam 46 and pusher block 42. The free end of the pusher rod can be configured other than as illustrated. For example, it can be provided by a pad of low-friction plastics material or incorporate a rotatable ball to facilitate movement of the device when the pusher is engaged with the end wall of the lighting fixture. Also the retaining clip 50 could be positioned intermediate the ends of the rod 40 instead of at the end thereof, all as will be apparent to persons skilled in art.

We claim:

1. A device for use in the removal and installation of single-pin type fluorescent tubes in lighting fixtures, including:

a cradle adapted to be positioned around a said tube intermediate the ends of said tube;

first means carried by said cradle for resiliently securing a said tube within said cradle against axial displacement relative thereto;

second means carried by said cradle and supported for axial movement in a direction parallel to a said tube, said second means having engagement means for engagement with an end wall of a lighting fixture;

third means carried by said cradle and operative to move said second means to an axially extended position; and, fourth means carried by said cradle for operating said third means from a position remote from said cradle;

whereby, operation of said third means is operative to move a said tube and said cradle in a direction axially of said tube and oppositely to the direction of movement of said second means upon engagement of said second means with a said end wall of a said lighting fixture;

in which said cradle has axially spaced end walls, and said second means includes a rod supported in said end walls for axial sliding movement in said end walls, an abutment member carried by said rod at a position intermediate said end walls, and means reacting between said abutment member and an adjacent end wall of said cradle and resiliently biasing said rod into a retracted first position;

said third means includes an eccentric cam supported for rotation about a longitudinal axis of said cam, said cam engaging said abutment member and being operative to cam said second means against said bias and into an extended second position; and said fourth means includes a stub-shaft journalled for rotation in said cradle and to which said eccentric cam is attached, and, means for attaching said stub-shaft to an extension pole, whereby said cradle and a fluorescent tube supported within said cradle can be manually manipulated, and, whereby rotation of said pole will result in operation of said second means from said first position to said second position resulting from rotation of said eccentric cam.

2. The device of claim 1 in which said cradle has axially spaced end walls, and said first means includes parallely arranged rollers journalled at their ends for rotation in said end walls and supported for lateral movement in said end walls, and, means resiliently biasing said rollers towards each other, thus permitting said rollers to be forced around the periphery of a said tube and then frictionally embrace said tube.

3. The device of claim 2 in which said resilient biasing means is provided by elastic belts entrained over said respective rollers, and extending under tension over second rollers journalled for rotation in said end walls.

* * * * *